US005941379A

United States Patent [19]

Barardo

[11] Patent Number: 5,941,379

[45] Date of Patent: Aug. 24, 1999

[54] TOILET RIM CLEANING APPARATUS

[76] Inventor: Steven Barardo, 464 S. Douglas St., Salt Lake City, Utah 84102

[21] Appl. No.: 08/900,525

[22] Filed: Jul. 25, 1997

[51] Int. Cl.[6] ..... A47K 11/10; A47L 13/10; A47L 13/51

[52] U.S. Cl. ..... 206/209; 206/15.3; 206/361; 15/104.94; 15/210.1; 15/244.1; 15/257.01; 15/257.05; 4/233; 401/9; 401/119

[58] Field of Search ..... 15/104.94, 210.1, 15/244.1, 257.01, 257.05; 4/222, 233, 661; 206/361, 362, 362.1–362.3, 15.2, 15.3, 209, 209.1; 401/118, 119, 9, 123, 125; 422/292, 300

[56] References Cited

U.S. PATENT DOCUMENTS

| | | | |
|---|---|---|---|
| 1,975,016 | 9/1934 | Nassif | 15/244.1 X |
| 2,841,808 | 7/1958 | Beyland | 15/257.05 X |
| 2,919,455 | 1/1960 | Turner | 15/210.1 X |
| 2,922,180 | 1/1960 | Render | 15/257.01 X |
| 3,168,984 | 2/1965 | Corning et al. | 401/125 X |
| 3,199,739 | 8/1965 | Corning et al. | 4/233 X |
| 3,319,281 | 5/1967 | Montgomery | 15/244.1 |
| 3,383,158 | 5/1968 | Leland | 15/210.1 X |
| 3,560,101 | 2/1971 | Leland | 206/361 |
| 3,759,375 | 9/1973 | Nappi | 206/361 X |
| 4,031,673 | 6/1977 | Hagelberg | 451/517 |
| 4,493,124 | 1/1985 | Agapiou | 15/104.94 |
| 4,601,081 | 7/1986 | Sutton et al. | 15/104.94 |
| 4,752,147 | 6/1988 | Persi | 401/123 X |
| 4,852,201 | 8/1989 | Wundrock et al. | 15/145 |
| 4,987,634 | 1/1991 | Weihrauch | 15/210.1 X |
| 5,067,194 | 11/1991 | Rosenfeld et al. | 15/144.2 |
| 5,099,541 | 3/1992 | Tressler | 15/257.05 |
| 5,471,697 | 12/1995 | Daconta | 15/104.94 |
| 5,488,748 | 2/1996 | Koch | 15/104.94 |
| 5,548,862 | 8/1996 | Curtis | 15/118 |
| 5,592,713 | 1/1997 | Rones | 15/210.1 |

FOREIGN PATENT DOCUMENTS

| | | | |
|---|---|---|---|
| 67225 | 6/1957 | France | 206/361 |
| 2645188 | 4/1978 | Germany | 15/210.1 |
| 477863 | 10/1969 | Switzerland | 206/361 |
| 1036428 | 7/1966 | United Kingdom | 15/257.05 |
| 1095542 | 12/1967 | United Kingdom | 15/257.05 |
| 2188540 | 10/1987 | United Kingdom | 401/9 |
| 87/00022 | 1/1987 | WIPO | 15/210.1 |

*Primary Examiner*—Mark Spisich
*Attorney, Agent, or Firm*—Workman, Nydegger & Seeley

[57] ABSTRACT

A toilet rim cleaning apparatus and method. The toilet rim cleaning apparatus includes a cleaning head which soaks in cleaning solution while not in use. This cleaning head includes material which is substantially absorbent. When utilized to clean the rim of a toilet bowl, the absorbent nature of the cleaning head permits excess fluid to be removed from the cleaned surfaces. The shape of the cleaning head is configured to conform to the shape of at least a portion of the rim of a toilet bowl, which facilitates the cleaning motion around the rim and allows a significant amount of the rim to be efficiently and effectively cleaned. One preferred embodiment of the shape of the cleaning head resembles an "L" shape. Another embodiment resembles a "U" shape.

22 Claims, 5 Drawing Sheets

TOILET RIM CLEANING APPARATUS

BACKGROUND OF THE INVENTION

1. The Field of the Invention

The present invention is directed generally to methods and apparatus for cleaning and sanitizing toilets. More specifically the present invention is related to methods and apparatus for cleaning and sanitizing the rim of a toilet bowl.

2. The Relevant Technology

Sanitation and cleanliness have long maintained a significant role in the lives and homes of many people. The bathroom, for example, is one area in the home wherein vigilant cleaning efforts are needed. Toilets must be kept clean in order to prevent unpleasant odors and eliminate, or at least control, harmful bacterial buildup. Thus, disinfectants and deodorizers are often utilized to maintain a fresh, substantially germ-free environment.

Cleaning solutions and brushes have been specifically developed for use with toilets, and especially conventional toilet bowls having a rim surrounding the bowl. For example, automatic cleaning solutions are available which are inserted into the tank or bowl of a toilet and dispense cleaner when the toilet is flushed. These types of cleaners, however, only superficially cleanse the toilet bowl and arc insufficient for removal of tough stains and bacterial buildup on the surface of the toilet bowl and surrounding areas.

Toilet bowl brushes arc commonly utilized for more thorough scrubbing of toilet bowls. These brushes are usually mounted on plastic shafts such that the user's hands need not contact the toilet during cleaning. Typically, toilet cleaning products are added to the bowl, and then the brush is used to scrub the bowl and surrounding areas, such as the seat and the rim of the toilet bowl. However, the use of a brush typically results in splashing and dripping of toilet bowl water onto outside surfaces of the toilet and on surrounding areas of the bathroom floor, or the person cleaning the toilet. Further, cleaning and storage of the brush after use may promote the transmission of harmful bacteria.

Additionally, some brushes are housed in a special brush storage unit. This storage unit typically allows the brush to drip dry, while the drippings collect on a bottom section of the storage unit. It should be appreciated that the drippings, even upon drying, can present an additional concentration of bacterial contamination and odor.

Another method of cleaning toilets employs hand held sponges and brushes to scrub the toilet and surrounding areas. Because such hand-held devices require the user to insert his or her hands into and around the toilet, the possibility of spreading bacterial contamination is increased. In addition, brushes and sponges typically leave a drippy mess, and are not particularly suited for repeated daily use.

The conventional toilet typically consists of a bowl encircled by a rim, and a seat that may be manipulated to cover the rim. It is common for males using a toilet for urination purposes to lift the seat. Splashing from the urine stream or other waste material contacting the toilet bowl or the water therein may occur during use of the toilet with the seat in either the up or down position. Thus, urine, toilet bowl water, or both may splash onto the rim and/or other areas of the toilet bowl. A consequence for the person who replaces the toilet seat into its normal position covering the rim of the toilet bowl is that his or her hands may inadvertently contact the splashed areas.

Disposable toilet seat covers have been utilized to prevent a user's direct contact with the toilet seat surface. Although these covers do provide a barrier to the bacteria covering the seat, they serve as neither disinfectants nor deodorizers. Further, these covers are disposed into the sewage system upon flushing of the toilet, wherein they add to the vast bulk of materials to be processed.

Conventional methods and devices for cleaning toilets do not adequately address the distinct cleaning needs of the toilet, and especially the toilet bowl rim. Further, because of the inconvenience and drawbacks associated with conventional toilet cleaning methods, cleaning the toilet bowl rim or seat rarely tends to occur after each use of the toilet.

SUMMARY AND OBJECTS OF THE INVENTION

It is therefore a primary object of the present invention to provide an improved method and apparatus for cleaning and sanitizing the rim of a toilet bowl.

It is another object of the present invention to provide an improved method and apparatus for cleaning the rim of a toilet bowl which does not leave the rim dripping wet.

It is still another object of the present invention to provide an improved method and apparatus for cleaning the rim of a toilet bowl which provides sanitary storage for the cleaning apparatus.

It is yet another object of the invention to provide an improved method and apparatus for cleaning the rim of a toilet bowl which facilitates cleaning the toilet rim after each use of the toilet.

These and other objects and features of the present invention will become more fully apparent from the following description and appended claims, or may be learned by the practice of the invention as set forth hereinafter.

To achieve the foregoing objects, and in accordance with the invention as embodied and broadly described herein, the present invention relates to a toilet rim cleaning apparatus and method. In one preferred embodiment, the toilet rim cleaning apparatus comprises a cleaning member including a cleaning head which preferably soaks in cleaning solution while not in use, and a handle.

The cleaning head preferably comprises material which is substantially absorbent. When utilized to clean around the rim of a toilet bowl, the absorbent nature of the cleaning head prevents excess fluid from being splashed about or from being left to drip from surfaces of the toilet bowl. The shape of the cleaning head is configured to conform to the shape of the rim of a toilet bowl to thereby facilitate cleaning of the rim. One preferred embodiment of the shape of the cleaning head resembles an "L" shape. An alternate embodiment resembles a "U" shape.

The cleaning head is attached to a handle shaped to effectuate control of the cleaning head, while avoiding hands-on contact with the cleaning head. In a preferred embodiment, the handle is a long, slender shaft, and may include a hand-grip portion at its distal end to enhance the user's hold and control.

As noted previously, the cleaning head preferably soaks in a cleaning solution while not in use. A preferred cleaning solution comprises a disinfectant, deodorizer, fragrance, anti-bacterial, sanitizer, or combination thereof. The cleaning solution is contained in a reservoir, which is preferably shaped so as to maximize the amount of cleaning solution covering the cleaning head. In one embodiment, the cleaning solution level covering the cleaning head is maximized due to a platform which rises from the reservoir such that a portion of the cleaning head rests thereon. In an alternate embodiment of the present invention, a portion of the cleaning head fits in a depressed portion of the reservoir such that at least a portion of the cleaning head is submerged in cleaning solution for the duration of the fluid.

An external housing provides a level base and protective covering for the reservoir. In one embodiment of the present invention, a door on one side of the external housing permits the cleaning member to be inserted into and withdrawn from the interior compartment of the external housing, wherein the cleaning head preferably rests in the reservoir. A hinge member allows the door to be manipulated into open and closed positions.

A preferred method for using the present invention involves the following steps. The door of the external housing is preferably opened by lifting upwardly and outwardly on the handle of the cleaning member. The cleaning head, which has preferably been soaking in cleaning solution, is then pressed against and swiped around the surface of the rim of a toilet bowl. The user controls the cleaning head with the handle, and thus the user's hands never need contact the toilet or the cleaning solution. In a preferred embodiment of the present invention, the cleaning head removes surface contamination and absorbs excess fluid under, around, and on top of the rim of the bowl. The cleaning head is then replaced into the reservoir to soak in cleaning solution. The door of the external housing is then closed, and the toilet is ready for the next user.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

The modern toilet, which is generally utilized for the immediate removal of individual human waste, typically consists of a water-filled bowl encircled by a rim, and a seat that may be manipulated to cover the rim. During use, surfaces inside and outside of the toilet and in the vicinity of the toilet tend to come in contact with water from within the toilet bowl and/or secretions and excretions of the users. Thus, it is important to be able to effectively and efficiently clean and sanitize toilets and toilet areas.

Figure 1:
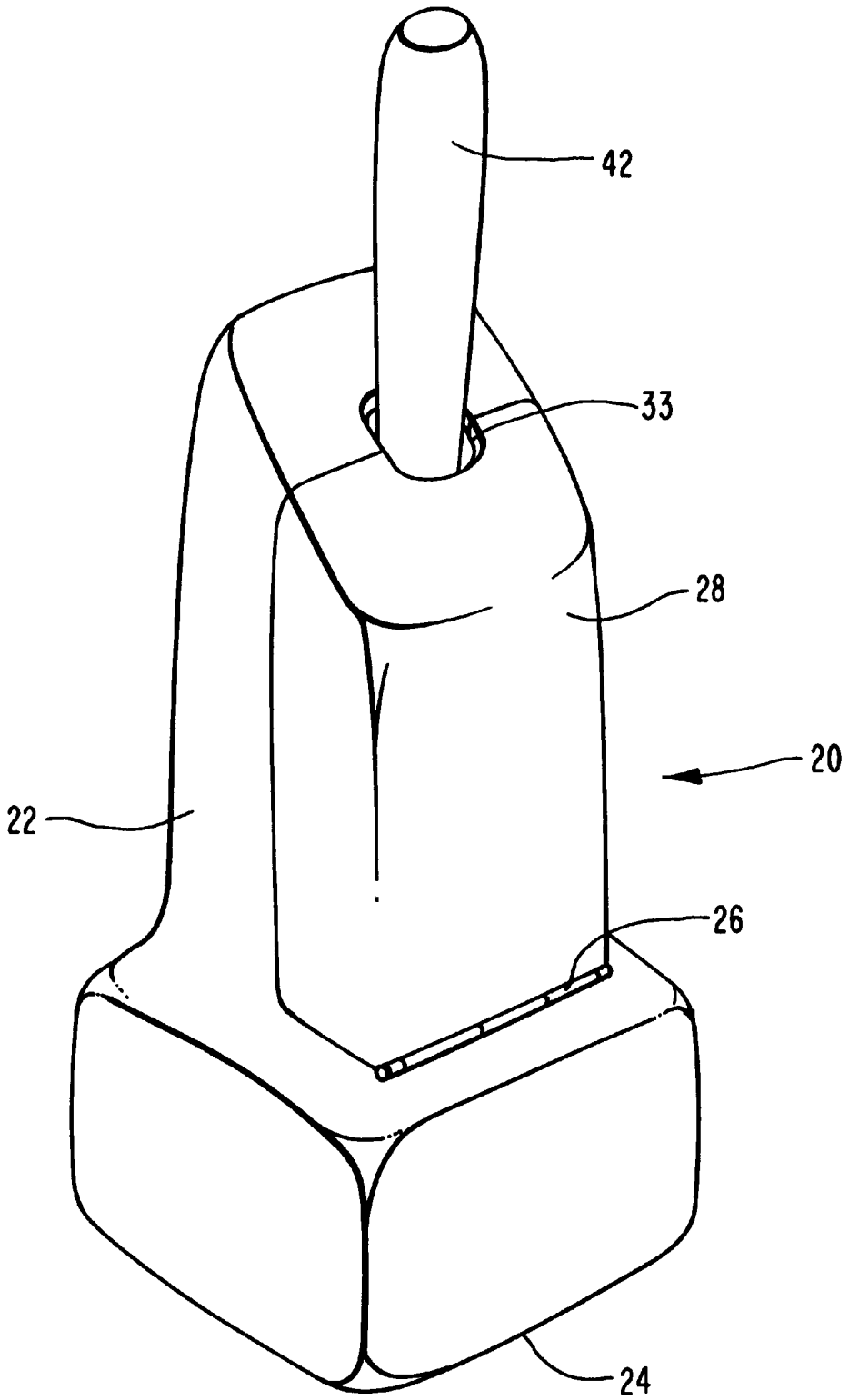
FIG. 1 is a perspective view of one embodiment of the apparatus of the present invention.

Various cleaning products have been developed for cleaning toilets, and especially toilet bowls. However, none has addressed the specific cleaning demands of the rim of the toilet bowl, and cleaning the toilet rim with conventional methods remains a relatively messy, inconvenient, and poorly effective task. In contrast, the present invention, which utilizes a substantially absorbent cleaning member that preferably soaks in cleaning solution while not in use and can advantageously and conveniently be utilized after every use of the toilet, is specifically addressed to the cleaning demands of the toilet bowl rim FIG. 1 illustrates an external view of an apparatus in accordance with the present invention, represented generally by numeral 20. Specifically, FIG. 1 illustrates exterior housing 22 which houses the cleaning member, reservoir, and cleaning solution of the present invention, each of which will be described in more detail hereinbelow. External housing 22 preferably comprises a rigid, yet flexible material, such as plastic. Alternatively, external housing may comprise various materials or combinations thereof suitable for bathroom settings including, but not limited to, ceramic, rubber, or porcelain.

Exterior housing 22 preferably includes a base 24 having a substantially flat bottom surface such that the apparatus as a whole may be situated stably on a floor or other level surface. It should also be appreciated by the features of the present invention detailed herein that the base 24 of the exterior housing may additionally comprise a textured or coated bottom surface which facilitates the grip of the base, especially, for example, on a tile floor. Alternatively, the exterior housing may be mounted on a wall, such as behind a toilet, thus eliminating the need for the base to have a substantially flat bottom surface.

Moreover, exterior housing preferably includes a hinge member 26 for the purpose of opening a door portion 28 of exterior housing. In a preferred embodiment of the present invention, hinge member 26 is connected to door portion 28 of external housing. Door portion 28 works in concert with hinge member to allow access to the interior of the housing. Suitable materials for hinge member 26 are known and include plastic, metal or other material that permits door portion to be opened and closed.

Figure 2:
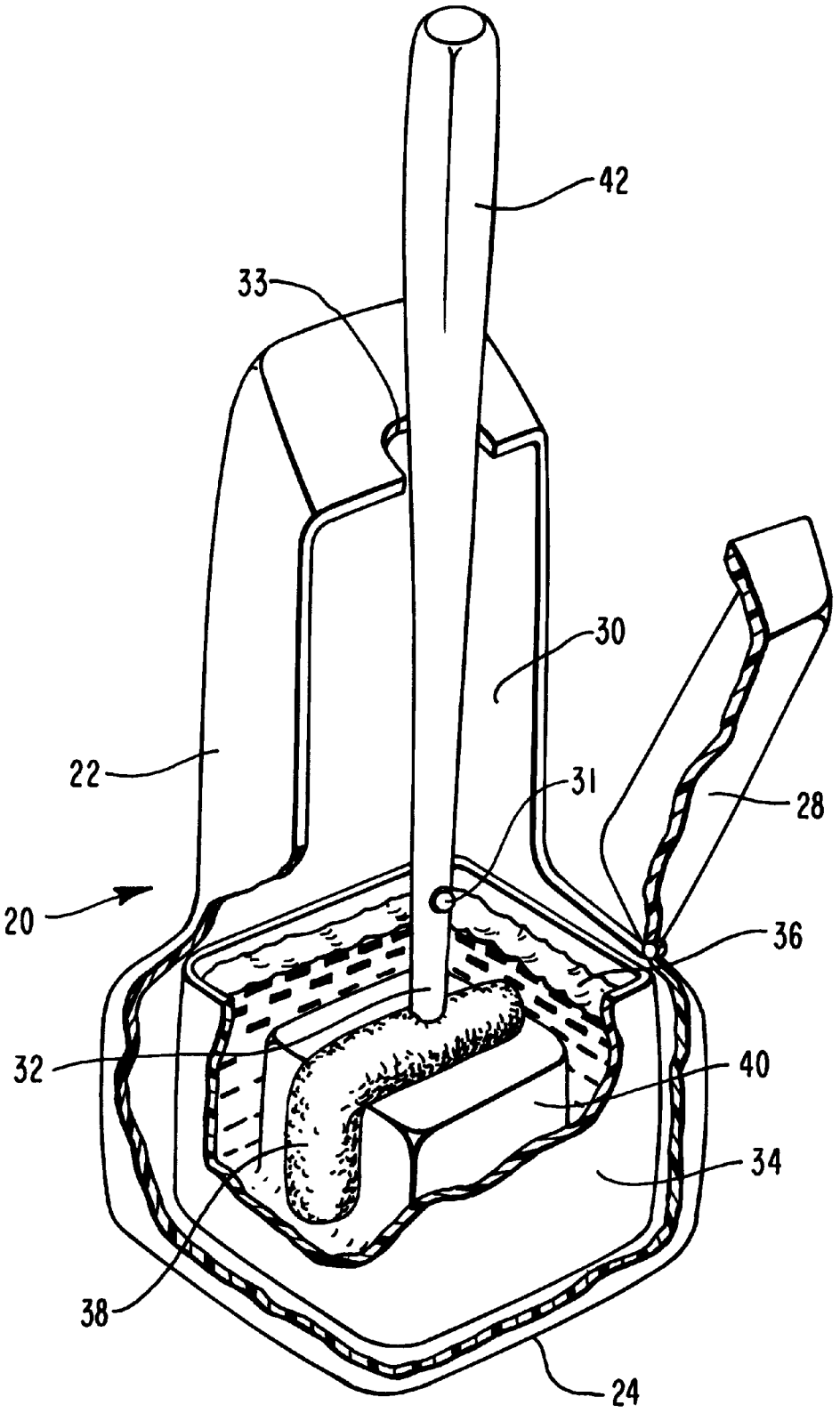
FIG. 2 is a partial cut-away view of the embodiment illustrated in FIG. 1.

FIG. 2 is an illustration of the embodiment of the present invention depicted in FIG. 1 with exterior housing 22 partially cut away so as to better visualize the interior compartment, represented generally by numeral 30. A segment of door portion 28 can be seen in a substantially open position in this figure. Interior compartment 30 houses a reservoir 34.

Reservoir 34 is preferably configured to fit within the exterior housing 22, and more preferably to fit upon the inside surface of the base 24 of exterior housing. In a preferred embodiment of the present invention, reservoir 34 fits snugly within exterior housing, preferably with the use of a snapping member, (not pictured). This prevents the reservoir from shifting and possibly spilling fluids contained therein.

In a preferred embodiment of the present invention, reservoir 34 contains cleaning solution 36, which preferably comprises a disinfectant, deodorizer, sanitizer, antibacterial, fragrance, or combination thereof. A desired cleaning solution is selected, filled, and refilled as per the preference of the user.

Alternatively, the reservoir itself can simply be replaced. In the embodiment of the present invention depicted in FIG. 6, reservoir 234 is obtained full of fluid and is utilized until it is empty, at which time reservoir 234 is simply discarded and a new, fluid-filled reservoir is obtained. Reservoir 234 snaps into elevated base 140 on the inside of the external housing 122.

The apparatus of the present invention additionally comprises a cleaning member, represented generally by numeral 32, as illustrated in FIG. 2. The cleaning member preferably includes a handle 42 (also shown in FIG. 1) and a cleaning head 38. In a preferred embodiment of the invention, while not in use for cleaning purposes, cleaning head 38 preferably soaks in cleaning solution 36, and rests upon elevated platform 40, which helps to maximize the effective submersion level of the cleaning head in the cleaning solution, as will be appreciated by inspection of FIG. 2. Platform 40 limits the interior volume of the reservoir available for the fluid, which in turn helps maintain a higher effective level of a quantity of fluid contained therein.

Figure 6:
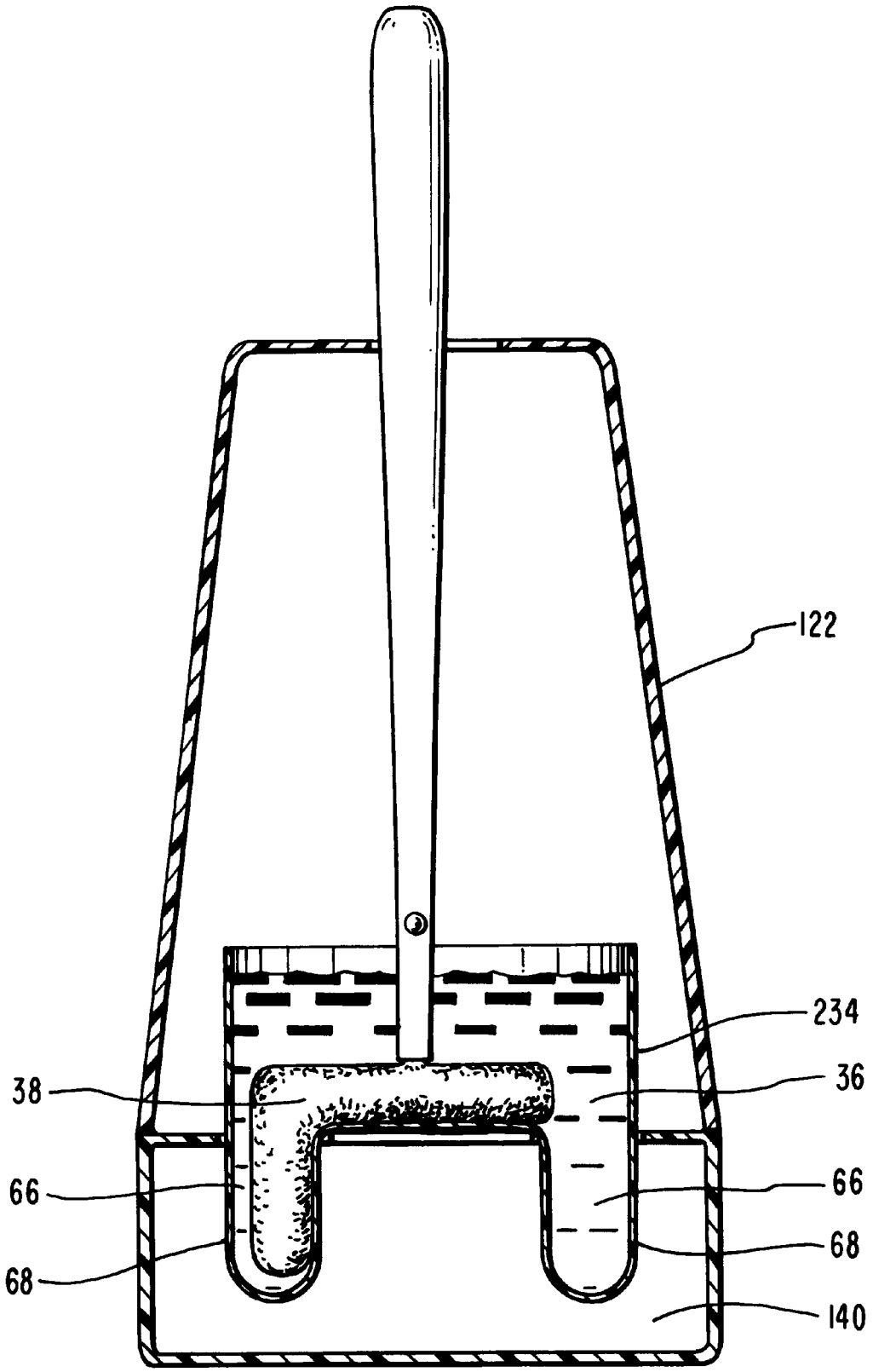
FIG. 6 is a cross-sectional view of another alternate embodiment of the apparatus of the present invention.

Alternatively, FIG. 6 illustrates an embodiment of the present invention wherein two male depressions 66 for accommodating a portion of the cleaning head 38 extend downwardly to snap into the reciprocal female indentations 68 in the elevated platform 140 of the external housing 122. It should be appreciated by inspection of FIG. 6, that fluid will cover at least a portion of the cleaning head virtually throughout the duration of the fluid.

Additionally, cleaning head 38 preferably comprises a material that is substantially absorbent such as a chamois, sponge, or other material that retains and absorbs moisture. During use, the cleaning head absorbs excess fluids and, thus, provides a virtually dripless cleaned surface.

Figure 3:
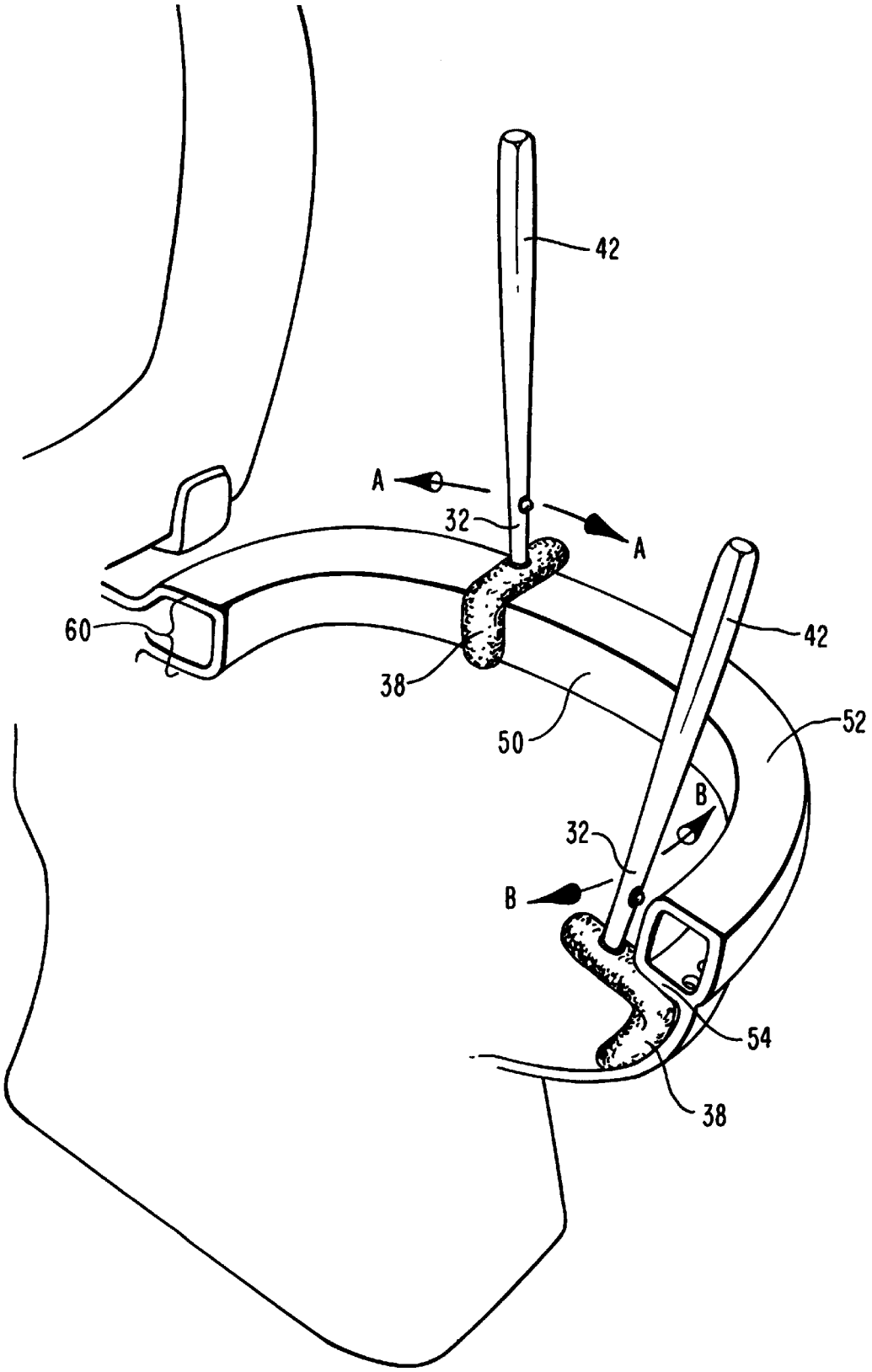
FIG. 3 illustrates two embodiments of cleaning members used in accordance with the present invention.

The cleaning head is preferably shaped to conform to the shape of a toilet bowl rim. FIG. 3, for example, illustrates an embodiment of a cleaning member wherein the shape of the cleaning head 38 substantially conforms to the upper surface 52 and inner side surface 50 of a toilet bowl rim 60 when held in one orientation (as shown by the directional arrows A) with respect to the rim, and substantially conforms to the underneath portion 54 of the rim when held in a second orientation (as shown by directional arrows B). Upon inspection of FIG. 3, it will be seen that the shape of the cleaning head resembles an "L" shape. Furthermore, the substantially rounded and tubular shape of the cleaning head 38 as illustrated in FIGS. 2, 3, and 6, promotes maximum contact with the rim of a toilet bowl.

Figure 4A:
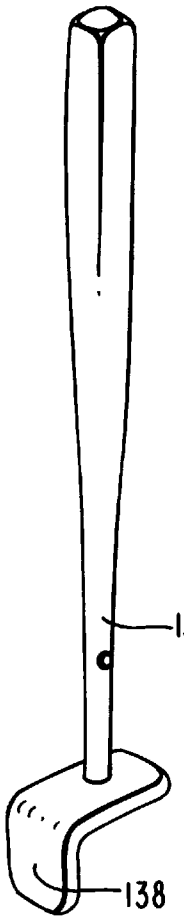
FIG. 4A is an illustration of an alternate embodiment of a cleaning member in accordance with the present invention.

It should be appreciated that other shapes and sizes of the cleaning head are within the scope of the present invention. For example, in an alternate embodiment of the present invention illustrated in FIG. 4A, the cleaning head 138 of cleaning member 132 comprises a wide and squared "L" shape.

Figure 4B:
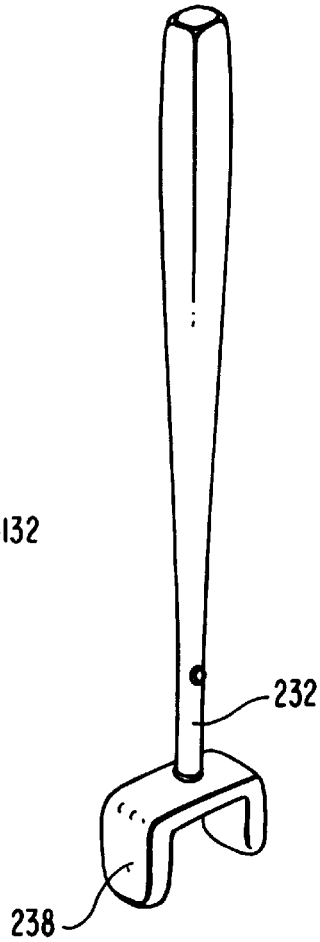
FIG. 4B is an illustration of another alternate embodiment of a cleaning member in accordance with the present invention.

In FIG. 4B, the cleaning head 238 of cleaning member 232 comprises a wide, square "U" shape. It should be appreciated that the "U" shape still conforms to both the top and underneath surfaces of a toilet bowl rim, and also while cleaning the top of the rim, simultaneously cleans both the inner and outer sides of the rim. It should also be appreciated that the cleaning head may comprise other shapes amenable to cleaning the rim of a toilet bowl without allowing excess fluid to remain thereon.

In a preferred embodiment of the present invention, the cleaning head is biased such that it fits snugly against the inner side surface of the rim of the toilet bowl. The cleaning head itself may be manufactured with inward tension such that it is form-fitting to many shapes and sizes of rims. Alternatively, a spring member may be utilized to adjust to the curvature of and thereby maintain contact with various toilet bowl rims.

As illustrated in FIG. 2, handle 42 is attached to cleaning head 38 and extends vertically therefrom such that manipulation of the cleaning head may be accomplished without actually touching the cleaning head. Handle 42 is advantageously sized to fit conveniently into a user's hand and may incorporate a grip portion at its distal end. In a preferred embodiment illustrated in FIG. 2, handle 42 is a vertical, slender shaft extending from the cleaning head. It should be appreciated, however, that other shapes, such as semicircular, would be within the scope of the present invention.

Furthermore, cleaning head 38 is preferably removably attached to handle 42. Handle 42 preferably includes discharge member 31 as illustrated in FIG. 2, which permits the expulsion of the cleaning head 38 from the handle 42. This allows removal of a cleaning head for replacement without the user's hands actually having to touch it.

In addition, exterior housing 22 preferably includes an upper opening 33 from which handle 42 can be seen extending, as illustrated in FIG. 1, wherein door portion 28 is closed, and in FIG. 2, wherein door portion 28 is partially opened.

The present invention is also directed to methods for cleaning the rim of a toilet bowl utilizing the device of the present invention. In FIG. 3, for example, the arrows labelled "A" serve to illustrate a method of the present invention wherein the cleaning head is used to clean the upper surface 52 and inner side surface 50 of the rim of a toilet bowl 60. The arrows labelled "B" help to illustrate a method of the present invention wherein the cleaning head is used to clean the underneath portion 54 of the rim of a toilet bowl 60.

In general, a preferred method for use of the apparatus of the present invention includes the following steps. First, a cleaning member is obtained from the interior compartment of the apparatus as a whole, by lifting upwardly and outwardly on the handle such that the door in external housing is opened. The cleaning head of the cleaning member will preferably have been soaking in cleaning solution in a reservoir within the housing prior to use.

Next, the cleaning head is pressed against and swiped around the rim in one or more orientations as desired to accomplish the cleaning. Upon completion of the cleaning task, the cleaning head is preferably placed back in the cleaning solution within the reservoir. The cleaning solution preferably disinfects the cleaning head and maintains the cleaning head in readiness for the next use.

Alternatively, it should be appreciated that a cleaning head in accordance with the present invention may be utilized substantially dry, i.e., without having been soaked in cleaning solution. Simply pressing and swiping the cleaning head on the surfaces will remove excess fluids and some contamination from the surface of a toilet bowl rim. In addition, cleaning solution can be applied directly to the toilet bowl surfaces before swiping or could be placed in the reservoir just prior to use.

While the invention has been described in connection with the rim of a toilet bowl, one skilled in the art will appreciate that the invention is not necessarily so limited and that it could also be utilized for the toilet seat, preferably before and after every use of the toilet.

Figure 5:
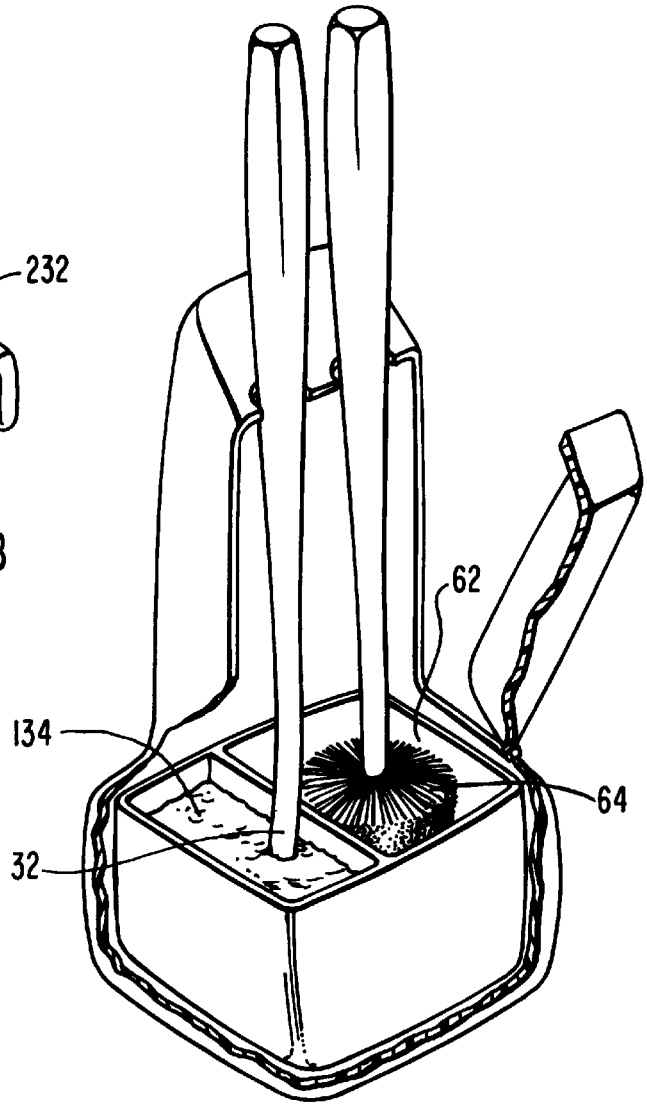
FIG. 5 is a partial cut-away illustration of an alternate embodiment of the apparatus of the present invention.

Moreover, FIG. 5 illustrates another embodiment of the present invention wherein a receptacle 62 for a toilet bowl cleaning brush 64 is situated immediately adjacent to the reservoir 134 of the present invention within exterior housing. This allows the cleaning member 32 and toilet brush 64 to be easily accessed and stored so as to facilitate the use thereof. Alternatively, the receptacle for the toilet bowl cleaning brush can be adjacent to the outside of exterior housing. It should also be appreciated that a plunger, a bottle of cleaning solution, or other toilet-cleaning supplies could alternatively be housed within such a receptacle.

It should be appreciated by the description of the invention provided hereinabove that the rim cleaning apparatus provides for improved cleaning and sanitizing of the rim of a toilet bowl. The absorbent feature of the cleaning head of the apparatus diminishes dripping and splashing around the rim during and after the cleaning process. Further the external housing of the present invention, along with the inner reservoir containing cleaning solution, provide improved methods and sanitary storage for the cleaning member. Finally the ease of application of the methods and apparatus of the present invention facilitates cleaning the toilet rim after each use of the toilet.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for cleaning a rim of a toilet bowl, said apparatus comprising:

a. a cleaning member comprising:

a cleaning head configured so as to substantially conform to at least a portion of a rim of a toilet bowl, said cleaning head further being substantially absorbent, said cleaning head including a first portion having a bottom surface, and a handle connected to said cleaning head; and b. a reservoir configured to accommodate said cleaning head, said reservoir having a bottom wall and an upper rim, said reservoir being further configured to hold a cleaning solution such that said cleaning head may be submersed therein, said reservoir being provided with an elevated platform extending from said bottom wall and having an upper surface spaced from and below said upper rim, the distance between said upper rim and said upper surface of said platform being greater than the thickness of said first portion of said cleaning head and said bottom surface of said first portion of said cleaning head being adapted to rest on said upper surface of said platform to maximize the effective submersion level of said cleaning head in said cleaning solution while said cleaning head is accommodated in said reservoir.

2. An apparatus as recited in claim 1, wherein said cleaning head is substantially "L" shaped.

3. An apparatus as recited in claim 1, wherein said cleaning head is substantially "U" shaped.

4. An apparatus as recited in claim 1, wherein said cleaning head comprises chamois material.

5. An apparatus as recited in claim 1, wherein said cleaning head comprises sponge material.

6. An apparatus as recited in claim 1, wherein said handle comprises a substantially rigid material.

7. An apparatus as recited in claim 1, wherein said solution comprises at least one disinfectant.

8. An apparatus as recited in claim 1, wherein said solution comprises at least one deodorizer.

9. An apparatus as recited in claim 1, wherein said solution is a solution selected from the group consisting of a disinfectant, deodorizer, sanitizer, anti-bacterial, fragrance, and combinations thereof.

10. An apparatus as recited in claim 1, further comprising an external housing which houses said reservoir.

11. An apparatus as recited in claim 10, wherein said external housing includes a base having a substantially flat bottom surface.

12. An apparatus as recited claim 10, wherein said reservoir is removable and is sized and configured to cooperate with said external housing so as to fit securely therein.

13. An apparatus as recited in claim 10, wherein said external housing comprises a door which provides open and closed positions.

14. An apparatus as recited in claim 13, wherein said door opens upon lifting outwardly and upwardly on the handle of said cleaning member.

15. An apparatus as recited in claim 10, wherein said external housing further comprises a receptacle.

16. An apparatus as recited in claim 1, wherein said cleaning head is sized and configured to conform to the rim of the toilet bowl, said cleaning head being biased so as to maximize the contact with the rim.

17. An apparatus as recited in claim 1, wherein said cleaning head is removably attached to said handle, said handle further comprises a discharge member disposed therein operably connected to said cleaning head such that upon said discharge member being activated said cleaning head is released and expelled from said handle.

18. An apparatus as recited in claim 1, wherein said cleaning head comprises an arm portion extending from said first portion.

19. An apparatus as recited in claim 18, wherein said arm portion extends from said first portion of said cleaning head at substantially a right angle thereto.

20. An apparatus as recited in claim 18, wherein said reservoir and said elevated platform are configured to accommodate said arm portion.

21. An apparatus as recited in claim 1, wherein said first portion of said cleaning head is substantially flat.

22. An apparatus for cleaning a rim of a toilet bowl, said apparatus comprising:

a. a cleaning member comprising a handle, and a cleaning head having a first portion and an arm portion extending therefrom, thereby being configured so as to substantially conform to at least a portion of a rim of a toilet bowl, said cleaning head being biased so as to maximize the contact with the rim, said cleaning head further being substantially absorbent, and wherein said cleaning head is removably attached to said handle, said handle further comprises a discharge member disposed therein operably connected to said cleaning head such that upon said discharge member being activated said cleaning head is released and expelled from said handle;

b. a reservoir configured to accommodate said cleaning head, said reservoir being further configured to hold a cleaning solution such that said cleaning head may be submersed therein, said reservoir being provided with an elevated platform configured to support said first portion of said cleaning head and to maximize the effective submersion level of said cleaning head in said cleaning solution while said cleaning head is accommodated in said reservoir; and c. an external housing which secures said reservoir therein, comprising a base having a substantially flat bottom surface, and a door portion providing open and closed positions.

* * * * *